US008484788B2

(12) United States Patent
Brewer et al.

(10) Patent No.: US 8,484,788 B2
(45) Date of Patent: Jul. 16, 2013

(54) BRUSHHEAD FOR ELECTRIC SKIN BRUSH APPLIANCE

(75) Inventors: Gerald K. Brewer, Redmond, WA (US); Robert E. Akridge, Seattle, WA (US); Kenneth A. Pilcher, Seattle, WA (US); Richard A. Reishus, Renton, WA (US)

(73) Assignee: L'Oreal SA, Paris (FR)

( * ) Notice: Subject to any disclaimer, the term of this patent is extended or adjusted under 35 U.S.C. 154(b) by 215 days.

(21) Appl. No.: 13/047,611

(22) Filed: Mar. 14, 2011

(65) Prior Publication Data

US 2012/0233798 A1 Sep. 20, 2012

(51) Int. Cl.
*A46B 9/02* (2006.01)
*A46B 13/02* (2006.01)

(52) U.S. Cl.
USPC ..... 15/28; 15/22.1

(58) Field of Classification Search
USPC ..... 15/22.1, 28
See application file for complete search history.

(56) References Cited

U.S. PATENT DOCUMENTS 4,202,068 A * 5/1980 Lester et al. ..... 15/28
6,058,541 A * 5/2000 Masterman et al. ..... 15/28

* cited by examiner

*Primary Examiner* — Randall Chin
(74) *Attorney, Agent, or Firm* — Clark A. Puntigam; Jensen & Puntigam, P.S.

(57) ABSTRACT

The brushhead is used in a power skin brush appliance which includes a drive system having a single drive member. The brushhead includes a base assembly mountable to the drive system with an optional outer annular fixed portion and an inner portion which in operation oscillates back and forth at a selected sonic frequency through a selected angle in response to action of the drive system. Mounted on the outer portion is a first group of filament tufts. Mounted on the oscillating portion are three concentric groups of filament tufts. Each oscillating group of filament tufts includes two annular rings of filament tufts. The filament tufts in the oscillating filament tuft groups have a selected physical characteristic which in one embodiment is diameter, which differs between the respective oscillating filament tuft groups sufficiently to produce a differential stiffness between the filaments thereof to in turn produce an out of phase motion of the tips of the filaments between the three oscillating filament tuft groups.

15 Claims, 4 Drawing Sheets

BRUSHHEAD FOR ELECTRIC SKIN BRUSH APPLIANCE

TECHNICAL FIELD

This invention relates generally to power skin brush appliances, and more specifically concerns the brushhead portion of the appliance.

BACKGROUND OF THE INVENTION

Power skin care brushes, such as those useful for cleansing of the facial region, are typically driven directly, such as by a drive shaft or shafts, gears and a motor. The skin brush typically includes a single brushhead, with a plurality of bristle/filament tufts, which move in unison. Some brushheads rotate (360°) in one direction continuously, while others oscillate through a selected angle. The higher frequency skin brushes are often referred to as sonic or sonic frequency brushes. Typically, the frequency range of such brushes is 120-300 Hz, usually producing some slight bristle tip flexing or whipping in addition to oscillation of the bristles. Such separate bristle tip movement usually does not occur in the lower speed scrub-type brushes. An example of such a sonic skin brush appliance and a brushhead is described in U.S. Pat. No. 7,320,691, which is owned by the assignee of the present invention, the contents of which are hereby incorporated by reference.

In some cases, the brushhead and drive system are configured so that portions of the bristle field of the brushhead move in different directions or move out-of-phase with the other portions. Such a particular movement may have advantages in facial cleaning, including the possibility of producing better cleansing with less discomfort. An appliance for producing such action is shown in U.S. Pat. No. 6,032,313. The brushhead assembly includes several concentric brush field portions, which are independently driven by separate mechanical means. However, not only is this a complicated drive structure, but it is not particularly suitable for the sonic speed appliances, because of noise and wear.

It remains desirable that a brushhead arrangement provide out-of-phase and/or counter-rotation action between different groups of bristle tufts but driven by a single drive mechanism.

DISCLOSURE OF THE INVENTION

Accordingly, the brushhead for use in a power skin brush appliance which includes a drive system having a single drive member, comprising: a base assembly mountable to the drive system having a moving portion which in operation oscillates back and forth through a selected angle and with a selected frequency in response to the drive system; and at least first and second concentric annular oscillating filament tuft groups mounted on the moving portion of the base assembly, wherein the first and second oscillating filament tuft groups each comprise at least one ring of filament tufts, the filament tufts in the first and second oscillating filament tuft groups, respectively, having a physical characteristic which differs sufficiently to produce a differential stiffness between the filaments comprising the first and second oscillating filament tuft groups to produce an out-of-phase motion of the tips thereof when wet.

BEST MODE FOR CARRYING OUT THE INVENTION

Figure 1:
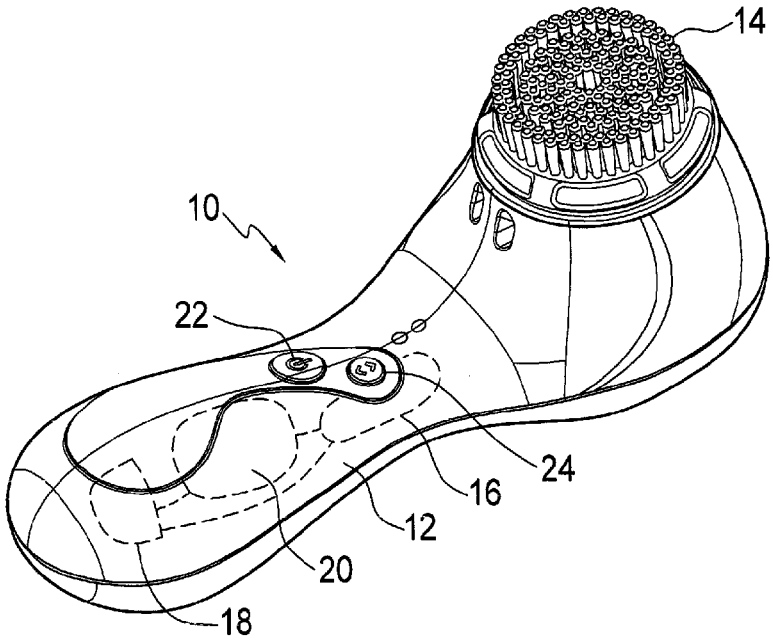
FIG. 1 is an isometric view of a power skin brush appliance which includes a bristle field brushhead.

FIG. 1 shows a power skin brush appliance, generally at 10. The appliance includes a handle portion 12 and a removable brushhead portion 14. The arrangement and configuration of brushhead portion 14 is the focus of the present description and claims. Within handle 12 represented for clarity is the operating structure of the appliance, including a drive motor assembly 16, powered by a rechargeable battery 18. The operation of the appliance is controlled by a microprocessor controller 20. The appliance also includes an on/off button 22 and a power or mode control button 24. The appliance of FIG. 1 is designed to operate the brushhead 14 at sonic frequencies, typically in the range of 166-186 Hz, oscillating the brushhead back and forth within a range of 6-12°. However, it should be understood that this is an example of the structure and operation of one such appliance and that the structure and operation frequency and oscillation angle of such an appliance could be varied.

Figure 2:
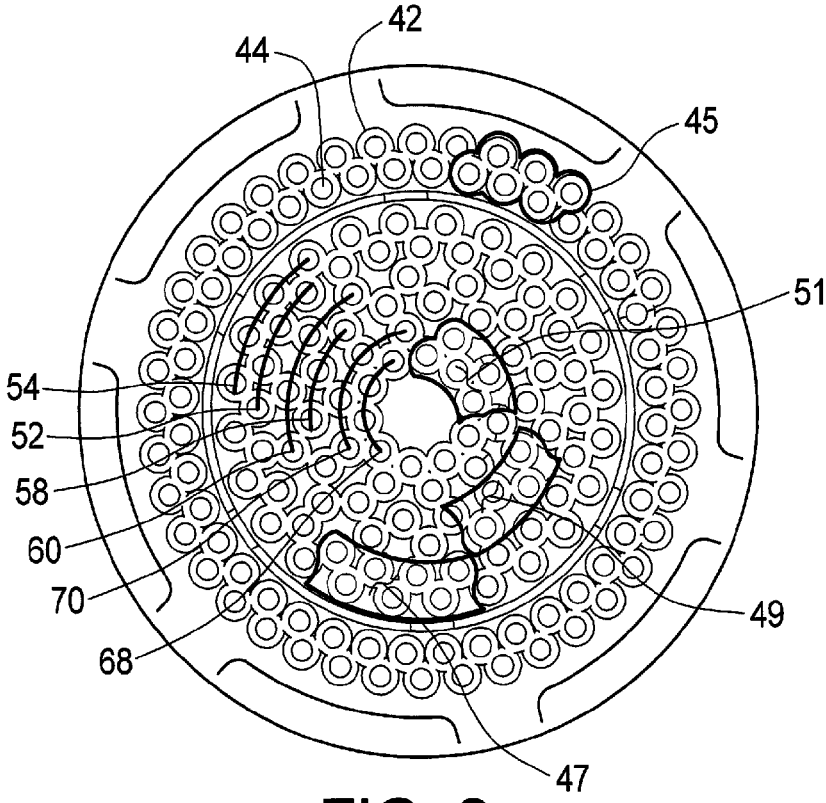
FIG. 2 is a top view illustrating the brushhead arrangement disclosed and claimed herein.
Figure 3:
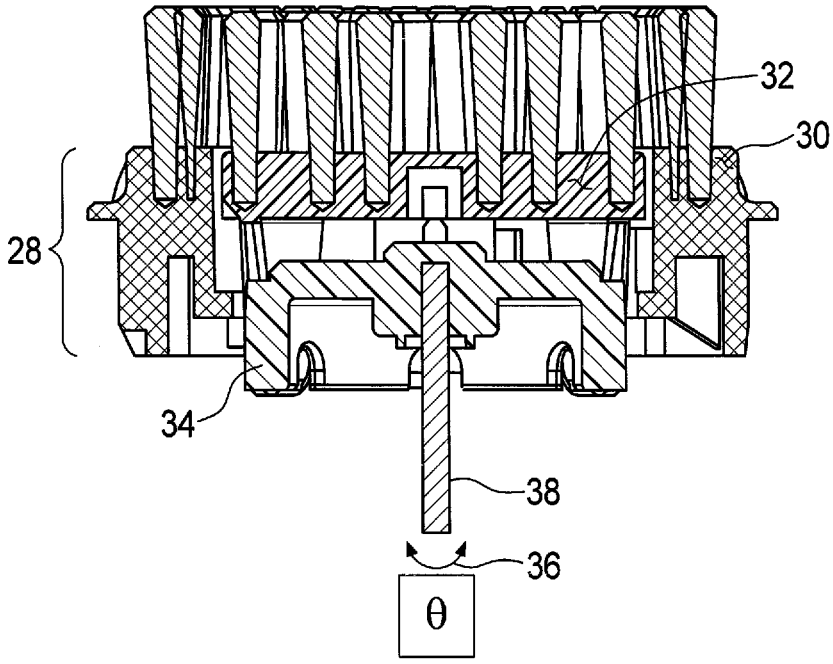
FIG. 3 is a cross-section of the brushhead of FIG. 2 and positioned on the drive mechanism similar to FIG. 1.
Figure 4:
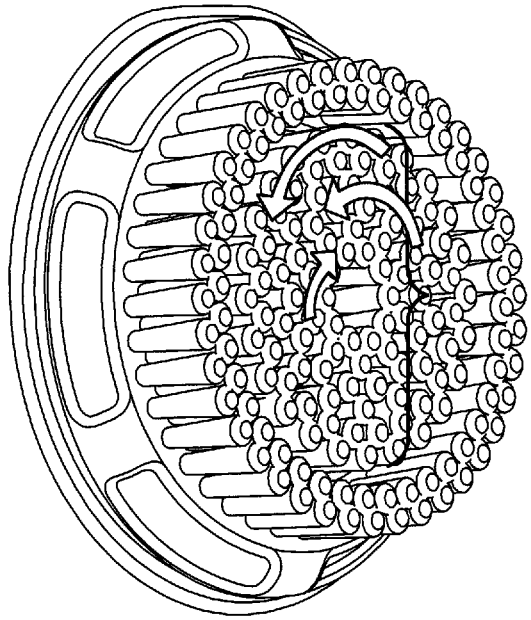
FIG. 4 is a perspective view showing the brushhead with actual bristle tufts.

FIGS. 2-4 show the new brushhead 14 and in particular one embodiment thereof which is presently preferred. The brushhead 14, referring to FIG. 3, includes a base assembly 28 which includes a fixed outer annular portion 30 and a movable center portion 32. In the embodiment shown, the fixed annular portion 30 has an outside diameter of 1.97 inches and an inside diameter of 1.26 inches, although these dimensions can be varied. The brushhead base assembly 28 is arranged to be removably positioned on a drive hub 34 which is driven by a motor 36 through a single drive shaft 38. Such a structure is shown and described in more detail in U.S. Pat. No. 7,786,628, owned by the assignee of the present invention, the contents of which are hereby incorporated by reference. In this arrangement, the connection between the drive hub 34 and base assembly 28 is such that movable portion 32 oscillates back and forth at a selected sonic power and frequency, through a selected angle, while annular portion 30 remains fixed in place. It should be understood that while the fixed portion 30 has certain advantages, such as a splash guard, it is not necessary to the present brushhead.

Brushhead 14 in a preferred embodiment includes two fixed annular rings 42, 44, (FIG. 2) of bristle/filament tufts mounted in the fixed portion 30 of the brushhead. Typically, in one arrangement, each ring will include approximately forty tufts, although this number can be varied. The individual filaments, including the diameter and material thereof, can be varied without affecting the desired action of the brushhead as described below. One example is a filament having a diameter of 0.004 and made from DuPont Hytrel® Supersoft (polyester) material. The two fixed rings 42 and 44 are referred to as a fixed tuft ring group 45.

The brushhead also includes three oscillating tuft ring groups, the oscillating tuft ring groups being concentric, each comprising two individual complete annular rings of filament tufts. These include a first oscillating tuft ring group 47, a second oscillating tuft ring group 49 and a third oscillating tuft ring group 51. The first oscillating tuft ring group 47, also referred to as an outer oscillating tuft ring group, has a midpoint diameter of approximately 0.5 inches, between the two annular rings 52, 54 of filaments tufts which comprise the first oscillating tuft ring group. The outer oscillating tuft ring group has individual tufts with filaments with a diameter of approximately 3 mils. Each annular ring has approximately 24 tufts, and a total of 148-160 filaments. The filament diameter (3 mils) in the outer oscillating tuft ring group provides a relatively soft, gentle feel to the skin.

The second oscillating tuft ring group 49, also referred to as the middle oscillating tuft ring group, also comprises two concentric annular rings 58 and 60 of filament tufts. The filaments in the middle oscillating tuft ring group in the embodiment shown have a diameter of approximately 4 mils. The midpoint diameter of the middle oscillating tuft ring group is approximately 0.35 inches. Each annular tuft ring comprises 14 tufts and 85-95 filaments in the embodiment shown.

The third oscillating tuft ring group 51, also referred to as the inner oscillating tuft ring group, comprises two concentric annular tuft rings 68 and 70, with the individual filaments having a diameter of approximately 5 mils. The midpoint diameter of the inner oscillating tuft ring group in the embodiment shown is approximately 0.196 inches. Each annular ring comprises approximately 10 tufts and 50-60 filaments in the embodiment shown.

The inner oscillating tuft ring group filaments, being stiffer than the filaments in the other oscillating tuft ring groups, helps to provide an effective cleaning result. In the embodiment shown, the filament material is DuPont Hytrel® supersoft (polyester), with the filaments having a length of 0.375 mm, although this can be varied. For instance, a length of 0.325 mm also provides desired action.

The arrangement, configuration and structure of the outer, middle and inner oscillating tuft ring groups, respectively, is such as to provide a differential stiffness between the tufts in one oscillating tuft ring group relative to the tufts in one or both of the other oscillating tuft ring groups. The difference in tuft and filament stiffness is sufficient so as to result in an out-of-phase movement and in some cases a counter-rotation of one oscillating tuft ring group relative to the other oscillating tuft ring groups. For the embodiment described above, with the three different diameters of the filaments, with the above material, there is close to a counter-rotation between the filaments, in particular the tips of the filaments, when wet, in the inner oscillating tuft ring group relative to the middle and outer oscillating tuft ring groups. The outer and middle oscillating tuft ring groups are somewhat out-of-phase relative to each other but only a relatively small amount, typically 30°-40° or so. In general, however, it is sufficient that there be a stiffness differential between the filaments in the respective oscillating tuft ring groups, due to difference in configuration, dimensions or material that there results an out-of-phase relationship between the tips of the filaments in a wet condition so that there be a relative (out-of-phase) tip displacement of 0.06 inches, resulting in a lateral force of 0.6 grams against the skin. One advantage of the out-of-phase arrangement to produce the desired tip displacement compared to other brushes having similar tip displacement in operation is more even cleansing over the entire surface of the brush by improvement of the action of the inner oscillating tuft group. It also results in better, more effective cleansing of the skin pores due to the smaller diameter of the filaments in the outer oscillating tuft group. The shear force between adjacent rows of filaments (bristles) is also enhanced by the out-of-phase action of the filament tips.

Figure 6:
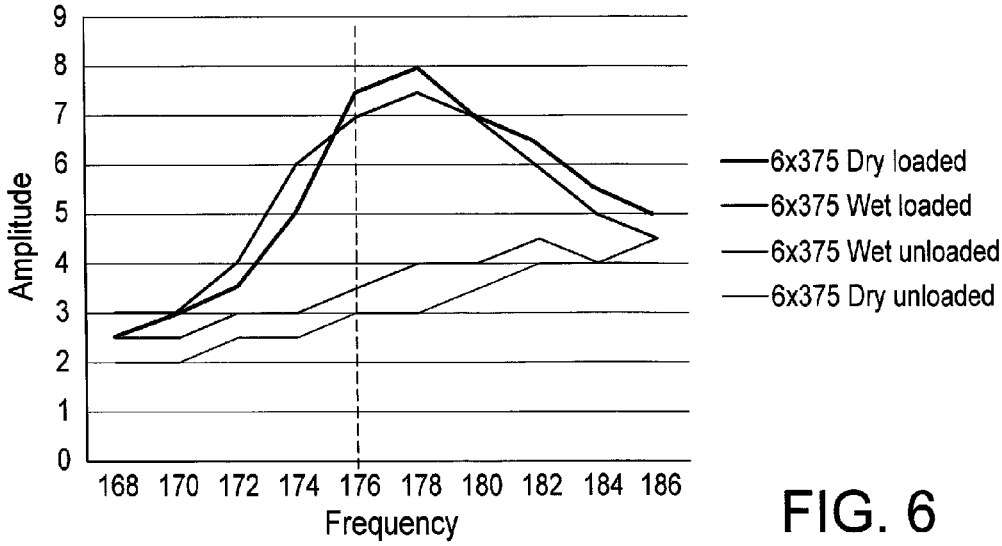
FIG. 6 is a diagram showing the difference in amplitude for the brushhead when in its dry and "wet" conditions, both loaded and unloaded.

In the embodiment shown, the out-of-phase action of one or more of the oscillating tuft groups relative to the other oscillating tuft groups is at least at 15°, and preferably at least 50-60° to provide the desired cleaning effect, while maintaining comfort. FIG. 6 shows the difference in filament tip action in a particular brushhead (6 rings, 0.375 mm) between wet and dry conditions and loaded/unloaded. The out-of-phase action produced by the current brushhead arrangement is most noticeable when the brushhead filaments are wet and loaded (positioned against the skin). The configuration/dimensions of the filaments in the embodiment of FIGS. 2-4 result in a gentle, comfortable feel with effective cleaning of the skin, as described above. In the case of the embodiment of FIGS. 2-4, this is accomplished by the filaments in the outer tuft rings being 3 mil diameter, relatively soft, the middle ring filament tufts somewhat stiffer at 4 mils, and the inner ring filaments being reasonably stiff with a 5 mil diameter. The holes in which the filaments are tufted typically have the same diameter; however, the diameter may also be varied somewhat to achieve slightly different tuft bending effects. A variance of ±50% is not an uncommon tuft hole variation of staple set technology. Greater hole size and shape of the tuft hole are possible if fused or in-molded brush making technology is used. The packing factor of the filaments in the holes can influence stiffness as well as the shape of the hole. Packing is important to maintain the preferred number of filaments in the tufts. The above filament diameters can vary somewhat while achieving the same effect.

Figure 5:
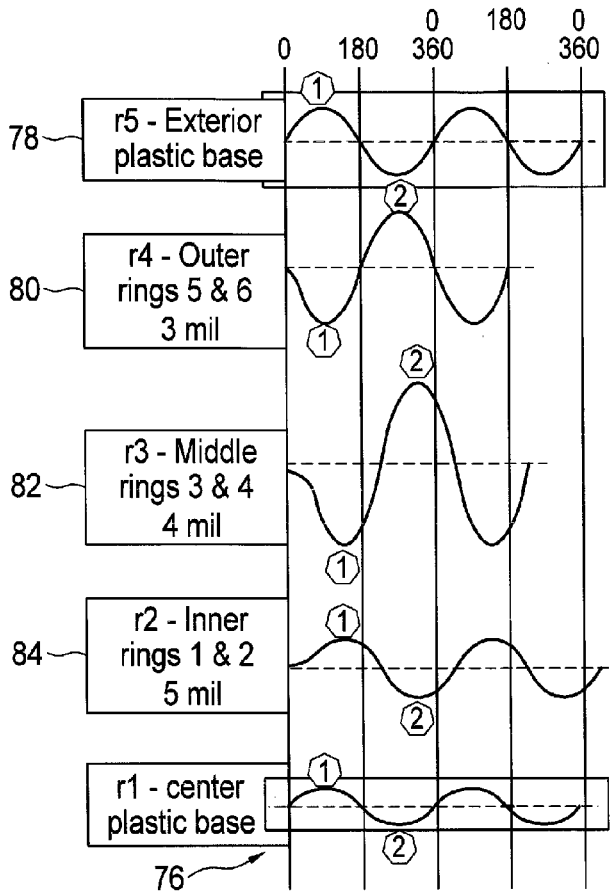
FIG. 5 is a phase diagram of the bristle action of the embodiment of FIG. 2.

FIG. 5 shows the out-of-phase relationship of the brushhead of FIGS. 2-4 in operation. The out-of-phase relationship is shown for the tips of the individual filaments with the filaments being wet. The movement of the outer and center portions of the oscillating portion of the brushhead base assembly is indicated at 76 and 78, respectively. The motion of the center and outer portions of the oscillating brushhead base assembly are exactly in phase, as would be expected, although the amplitudes thereof are different, due to the different radii of those two portions of the brushhead base assembly. The brushhead base assembly oscillates in operation by the drive system from a rest position to one end of its oscillating travel, back to the rest position, then to the other end of its oscillating travel and finally back to the rest position.

With the different diameters of the filaments in the oscillating three tuft ring groups, the wet tips of the filaments in the middle and outer tuft ring groups are out-of-phase with each other by perhaps 30°-40°, as shown by the 80 and 82 diagrams, while the tips of the wet filaments in the inner oscillating tuft ring group are sufficiently out-of-phase with the middle and outer ring group filaments that there is basically a counter oscillation, as shown at 84 in the diagram. Other out-of-phase relationships can be obtained by varying the diameter of the filaments somewhat differently but it is important that there be an out-of-phase relationship of at least 15° to produce the desired effects.

In addition to the differences in diameter and bristle count per tuft which account for the necessary differential stiffness between the filaments to produce the required out-of-phase movement of the filament tips, other physical characteristics of the filaments can be varied to produce the necessary differential stiffness. These include the material of the filaments and the individual length of the filaments. The differences must be sufficient, however, to provide at least a 15° out-of-phase relationship between one of the oscillating tuft ring groups and at least one of the other oscillating tuft ring groups to produce effective results. As one example, the filaments in the three oscillating tuft ring groups, respectively, could comprise solid, round (cross-section) nylon material (stiffest); solid, round polyester material; and hollow, round polyester material (softest) to produce the desired out-of-phase movement of tips of the bristles when wet.

Figure 7:
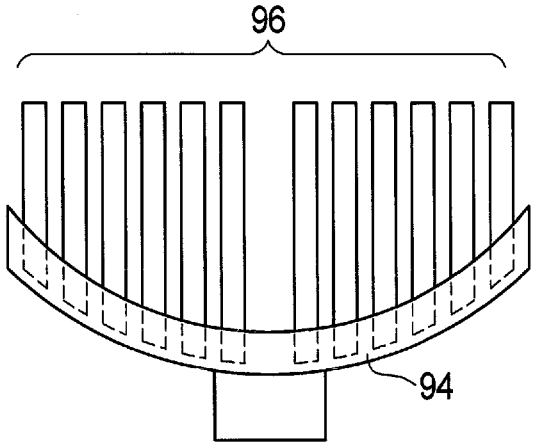
FIG. 7 is a cross-sectional diagram showing a brushhead for bristle tufts with varying lengths.
Figure 8:
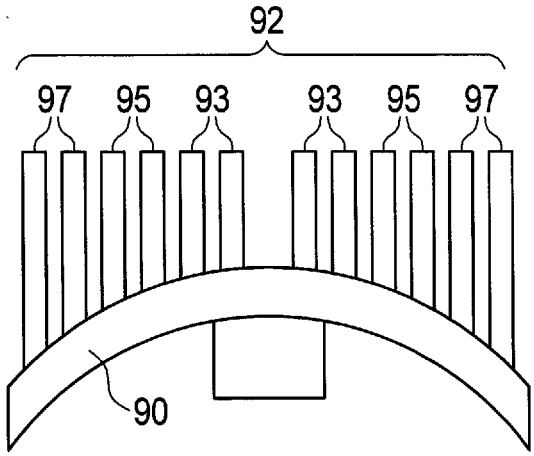
FIG. 8 is a cross-sectional diagram showing an alternative brushhead to that of FIG. 7.

Another variation concerns the length of the individual filaments. Since it is desired that the tips of the bristles be in substantially the same plane, the length of the individual bristles is achieved by varying the configuration of the base assembly. For instance, in one arrangement, the base element has a convex configuration, as shown in FIG. 8. The base is shown at 90, with the individual filaments being shown at 92. In this case, to achieve the desired out-of-phase relationship, assuming a filament diameter of 4 mils, using DuPont Hytrel® supersoft polyester material, the approximate length of the first (inner) oscillation tuft group 93 is 0.325 inches, the approximate length of the second oscillating tuft ring group 95 is 0.375 inches, and the approximate length of the third (outer) oscillating tuft ring group 97 is 0.460 inches. Depending on the desired skin cleansing or exfoliation effect desired, an opposite stiffness effect can be achieved by a concave base assembly configuration, shown in FIG. 7, comprising a base 94 and filaments 96. A stair-step base assembly configuration could also be used for both concave and convex base assembly configurations.

As a further variation, it should be understood that, while in the preferred embodiment, there are three oscillating tuft ring groups, there could be two oscillating tuft ring groups or more than three, for instance, four or even six tuft ring groups. Still further, while the arrangement shown uses two individual tuft rings comprising each oscillating tuft ring group, as well as the fixed tuft ring group, it is possible to use a single tuft ring in one or more of the tuft ring groups, or more than two in other cases. Again, the arrangement must be such as to have a sufficient differential in stiffness between the filaments in the oscillating tuft ring groups so as to produce an out-of-phase movement between the tips of the filaments (when wet) comprising each tuft ring group. In some cases, the out-of-phase relationship is sufficient to produce a counter-rotation between the filaments in one oscillating tuft ring group and the filaments in the other oscillating tuft ring groups.

While the arrangement of FIGS. 2-4 and the specific diameters of the filaments disclosed produce a resulting action which is gentle on the skin yet effective for skin cleansing, in particular the facial area, it should be understood that other filament arrangements with differing stiffness arrangements can be used to produce other skin effects. For instance, the filaments could be made stiffer, such as a larger diameter filament in the outer oscillating tuft ring group, to provide effective exfoliation while still having an out-of-phase tip motion for effective cleaning.

Hence, a new brushhead arrangement has been disclosed utilizing a plurality of concentric oscillating tuft ring groups, with the individual tufts having filaments constructed or configured so as to provide a differential stiffness between the tufts in the respective ring groups producing an out-of-phase and even counter-rotation effect of the tips of the bristles when wet, resulting in increased effectiveness of the brushhead while producing a gentle, comfortable feel for facial cleansing.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A brushhead for use in a power skin brush appliance which includes a drive system having a single drive member, comprising:

a base assembly mountable to the drive system having a moving portion which in operation oscillates back and forth through a selected angle and with a selected frequency in response to the drive system; and at least first and second concentric annular oscillating filament tuft groups mounted on the moving portion of the base assembly, wherein the first and second oscillating filament tuft groups each comprise two adjacent rings of filament tufts, the filament tufts in the first and second oscillating filament tuft groups, respectively, being characterized by differential stiffness to produce an out-of-phase motion between the tips of the filaments in the first oscillating filament tuft group relative to the tips of the filaments in the second oscillating filament tuft group when the first and second filament tuft groups are wet.

2. The brushhead of claim 1, wherein the base assembly includes a fixed annular outer portion about the moving inner portion, and wherein the brushhead includes a fixed tuft group mounted to form an annular ring on said fixed outer portion.

3. The brushhead of claim 2, wherein the out-of-phase motion is at least 20-25°.

4. The brushhead of claim 2, wherein the out-of-phase motion is at least 90°.

5. The brushhead of claim 2, wherein the material comprising the filaments in the three oscillating filament tuft groups is sufficiently different to provide a differential stiffness resulting in said out-of-phase motion of the tips of the filaments.

6. The brushhead of claim 2, wherein the base assembly is configured so that different lengths of the filaments between the three successive groups to produce said differential stiffness.

7. They brushhead of claim 6, wherein the base assembly has a concave configuration.

8. The brushhead of claim 6, wherein the base assembly has a convex configuration.

9. The brushhead of claim 2, wherein the differential stiffness is due to differences in at least two of the following characteristics: (1) filament diameter; (2) filament material; and (3) filament length.

10. The brushhead of claim 1, wherein the out-of-phase motion is sufficient to produce a relative lateral displacement of 0.06 inches between the tips of the filaments comprising the oscillating filament tuft groups.

11. The brushhead of claim 1, including a third concentric annular oscillating filament tuft group mounted on the moving portion of the brush assembly, wherein each oscillating filament tuft group includes two adjacent annular rings of filament tufts, wherein the filament tufts in the three oscillating filament tuft groups are physically characterized such that the filament tips of one filament tuft group oscillate substantially counter to the filament tips of the other two oscillating filament tuft groups.

12. The brushhead of claim 11, wherein the first oscillating filament tuft group is an outermost group and comprises filaments with a 3 mil diameter, the second oscillating filament tuft group is a middle group and comprises filaments with a 4 mil diameter and the third oscillating filament tuft group is an innermost group and comprises filaments with a 5 mil diameter, and are otherwise structured so that the tips of filaments in the third group counter-oscillate relative to the tips of the filaments in the first and second groups.

13. The brushhead of claim 12, wherein the length of the filaments is approximately 0.375 mm.

14. The brushhead of claim 12, wherein the first oscillating filament tuft group comprises approximately 24 tufts and 148-160 filaments in each annular ring thereof, wherein the second oscillating filament tuft group comprises approximately 14 tufts, with 85-95 filaments, in each annular ring thereof and wherein the third oscillating filament tuft group comprises approximately 10 tufts and 50-60 filaments into each annular ring thereof.

15. The brushhead of claim 11, wherein a same physical characteristic differs between at least two of the three oscillating filament tuft groups.

* * * * *